US005823976A

United States Patent [19]

Cain et al.

[11] Patent Number: 5,823,976

[45] Date of Patent: Oct. 20, 1998

[54] APPARATUS FOR TREATING UPPER EXTREMITY MOVEMENT DISORDERS

[76] Inventors: Tod Cain, 1736 Bay Hill Dr., Oldsmar, Fla. 34677; Duane Stearns, 921 Westwinds Blvd., Tarpon Springs, Fla. 34689

[21] Appl. No.: 634,131

[22] Filed: Apr. 19, 1996

[51] Int. Cl.[6] ..... A61H 1/00

[52] U.S. Cl. ..... 601/23; 601/24; 297/411.36; 297/411.38; 297/411.23; 248/287.1; 248/284.1

[58] Field of Search ..... 297/411.36, 411.38, 297/411.23, 411.26; 248/287.1, 284.1, 295.11, 298.1; 601/5, 23, 24, 33; 482/133, 134, 139, 904, 908; 403/321, 322, 325; 280/304.1

[56] References Cited

U.S. PATENT DOCUMENTS

| | | | |
|---|---|---|---|
| 3,074,762 | 1/1963 | Kris | 297/411.26 |
| 3,754,547 | 8/1973 | Walker | 601/24 |
| 3,853,372 | 12/1974 | Meyer | 297/411.36 |
| 4,489,981 | 12/1984 | Goletski | 297/411.36 |
| 5,031,912 | 7/1991 | Vaughn et al. | 482/139 |
| 5,242,138 | 9/1993 | Kernberg | 297/411.36 |
| 5,518,485 | 5/1996 | Zislis | 482/139 |
| 5,586,811 | 12/1996 | Tornero | 297/411.36 |
| 5,599,067 | 2/1997 | Schuelke et al. | 297/411.36 |

*Primary Examiner*—Jeanne M. Clark
*Attorney, Agent, or Firm*—Joseph C. Mason, Jr.

[57] ABSTRACT

A therapeutic device for treating upper extremity disorders is detachably secureable to a wheelchair frame or other suitable support. A mounting bar is positionable at differing heights and at differing angles of adjustment relative to the frame and both the height and the angle are easily changed without tools as the patient progresses in response to treatment. The mounting bar also detachably receives any number of therapeutic devices to further aid the patient's recovery, and those devices are attachable to the mounting bar without tools.

19 Claims, 14 Drawing Sheets

APPARATUS FOR TREATING UPPER EXTREMITY MOVEMENT DISORDERS

BACKGROUND OF THE INVENTION

1. Field of the Invention

This invention relates, generally, to an arm guidance system for treating individuals having upper extremity movement disorders. More particularly, it relates to therapeutic devices attachable to a wheelchair frame or other support structure.

2. Description of the Prior Art

Certain brain injuries can lead to motor or sensory deficits, or both; affected individuals often lose the ability to move, control, or even feel their upper extremities. As a result, the individual's arms and hands may be injured when the arm falls from a support surface under the influence of gravity. Such falls can result in joint separations, loss of hand arches, bruises, skin tears, and the like.

Affected individuals often position their affected upper extremities atop any available support surface. When the selected surface is inappropriate, the problems associated with loss of motor control are aggravated; joint contractures, joint compressions, bruises, skin tears and the like may arise. If such inappropriate support is sustained over a length of time so that dysfunctional patterns of muscle activation are overused, such patterns become the dominant movement pattern. Thus, the time required for corrective therapy is increased.

Like most physical systems, the human body must work to maintain a status quo; improvements or degeneration continually occur. Patients with upper extremity problems who do not receive proper environmental stimulation will degenerate. Patients must be challenged to continually improve; in the absence of new challenges, degeneration sets in.

What is needed, then, is a therapeutic apparatus or system that properly aligns, supports and motorically challenges affected upper extremities. The needed system would be gradable, i.e., it would be easily reconfigurable as needed to progressively challenge the patient as therapy continues, or to challenge the patient to a lesser extent if his or her condition requires decreasing challenge. Thus, the needed system would enable a therapist to gradually align the upper extremities, to gradually mobilize tight joints, and to provide progressive or regressive motor challenges as the patient's motor status changes.

A need also exists for a system that can be quickly and easily adjusted without tools.

However, in view of the prior art at the time the present invention was made, it was not obvious to those of ordinary skill in the pertinent arts how the needed apparatus could be provided.

SUMMARY OF THE INVENTION

The longstanding but heretofore unfulfilled need for improvements in upper extremity treatment devices is now met by a device that is detachably connectable to a wheelchair, a conventional chair, or other suitable device for supporting, mobilizing, and gradually challenging the patient's motor system.

It should also be understood that the novel elements disclosed herein may also be provided as a part of original equipment, i.e., they need not be retrofit onto existing wheelchairs or other devices.

The novel apparatus includes a pair of upstanding base members that are detachably securable to a wheelchair frame, or other similar frame. The base members slideably receive a pair of slotted and toothed uprights that interconnect the base members and a mounting arm.

A locking bar, also slideably disposed with respect to the upstanding base members, includes stop members that engage the teeth of the uprights when the locking bar is in repose, such engagement locking the uprights and hence the mounting bar into any number of positions of vertical and angular adjustment relative to the locking bar.

The locking bar is disengaged from the teeth when in a position of nonrepose; when so positioned, the mounting bar can be repositioned into any number of positions. A bias means maintains the locking bar in its position of repose, but a handle at the distal end of the locking bar facilitates overcoming the bias.

The mounting bar is adapted for releasable engagement with an attachment plate, and any number of therapeutic instruments may be detachable secured to said attachment plate.

It is therefore understood that the primary object of this invention is to provide better tools for the effective treatment of upper extremity disorders.

A related object is to provide the needed tools in a form that enables gradable treatment of patients so that their environment may be gradually changed to properly challenge them as their condition improves.

A closely related object is to provide a comprehensive apparatus that defines the movement patterns of a patient so that subluxations, skin tears, and other problems may be avoided or overcome.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
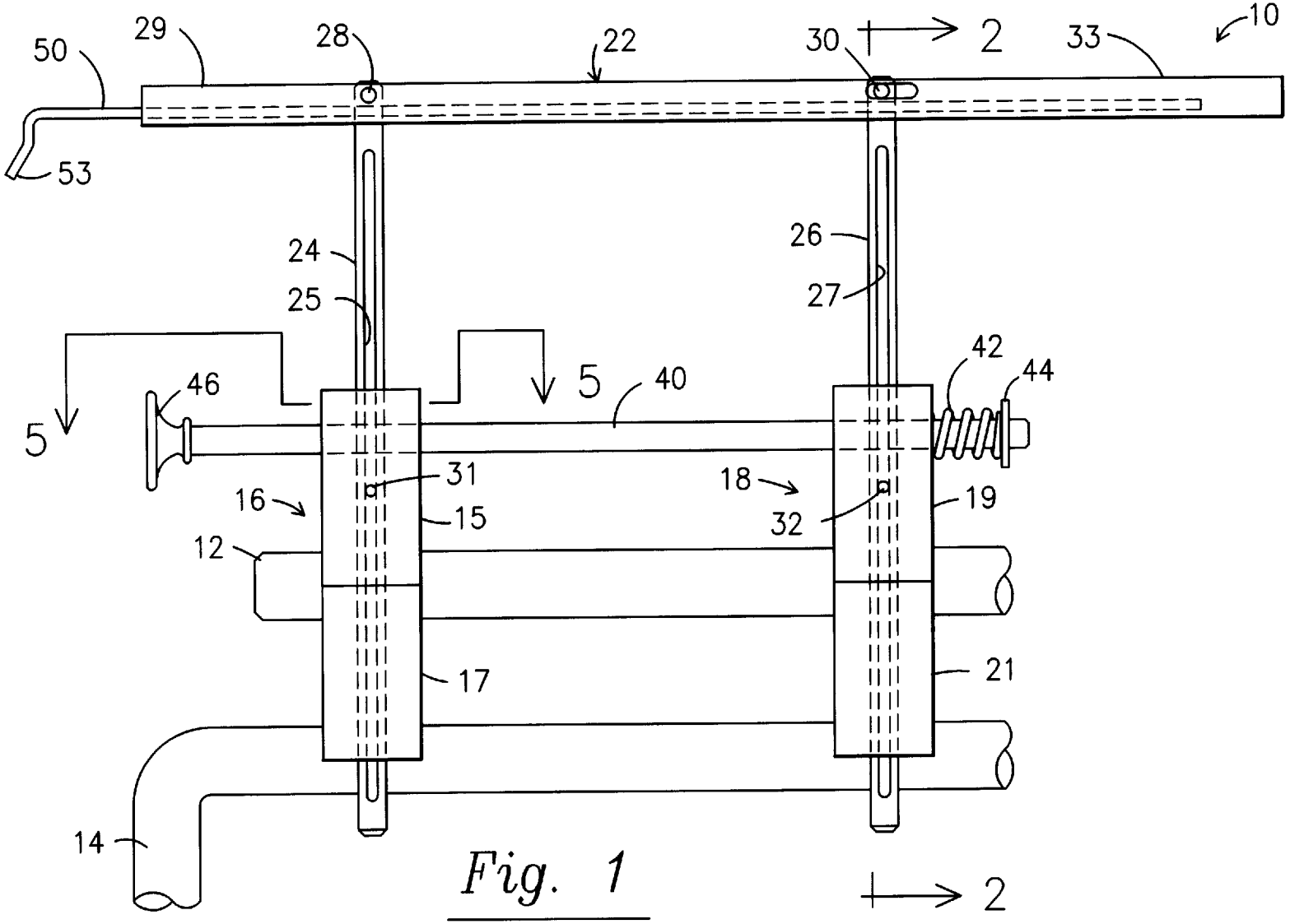
FIG. 1 is a side elevational view of the novel mounting bar, the novel base, and the novel uprights that interconnect them.

Referring now to FIG. 1, it will there be seen that an exemplary embodiment of the invention is denoted as a whole by the reference numeral 10.

Tubular frame members 12 and 14 are parts of a wheelchair frame of the type having removable arm rests; frame 12 is movable up and down in a vertical plane. Frame members 12, 14 provide the foundation upon which the novel apparatus is mounted.

More particularly, base members 16 and 18 are spaced apart from one another by a predetermined distance and are formed by independent parts 15, 17 and 19, 21, respectively. The respective bottom surfaces of parts 15 and 19 have a semicircular recess formed therein, as do the respective top surfaces of parts 17 and 21. Accordingly, said recesses collectively form bores having a diameter equal to the diameter of frame member 12 so that base members 16 and 18 are tightly secured to said frame member 12 when their respective parts 15, 17 and 19, 21 are secured to one another by suitable means. In other words, abutting faces of base member parts 15, 17 are cooperatively formed to sandwich frame member 12 between them, as are the abutting faces of base member parts 19, 21.

Similarly, the respective bottom surfaces of parts 17 and 21 are recessed to accommodate the upper surface of frame member 14.

Figure 7:
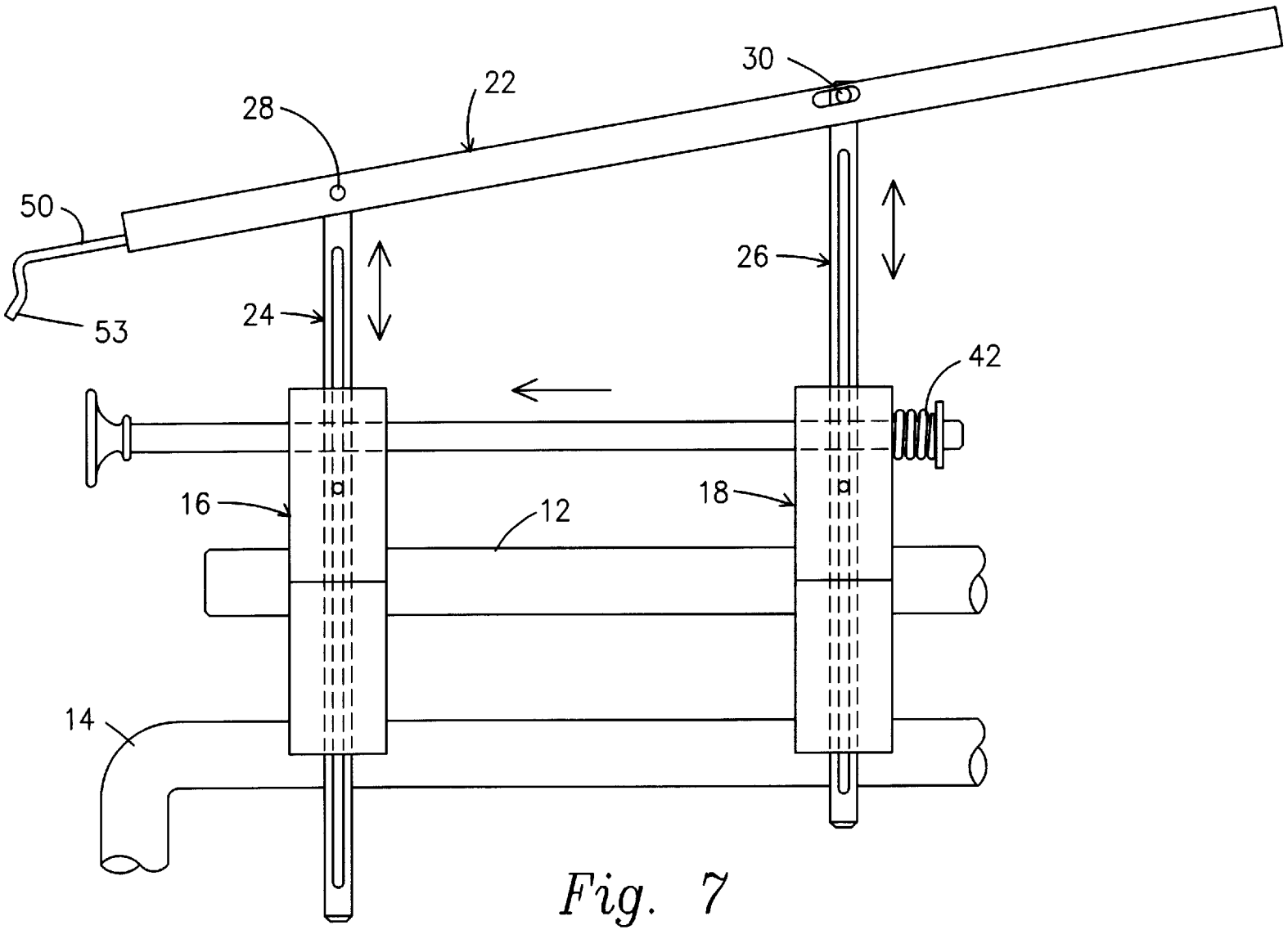
FIG. 7 is a side elevational view similar to FIG. 1, depicting the system during a repositioning of the novel mounting bar.

Mounting bar 22 is interconnected to base members 16, 18 by uprights 24, 26, respectively. Pivot pins 28, 30 enable mounting arm 22 to be positioned in any number of angular orientations relative to a horizontal plane, as indicated in FIG. 7. Note that pivot pin 30 is positioned in a slot so that it can ride therein as needed during adjustments.

A patient's forearm may be positioned with the wrist below the elbow, as in the FIG. 7 example, with the wrist above the elbow, or with the wrist and elbow lying in a common horizontal plane.

Upright 24 is slotted as at 25 and upright 26 is slotted as at 27. Guide pin 31, mounted in base part 15, extends into slot 25 and performs the function its name expresses, i.e., it cooperates with pivot pin 28 to maintain uptight 24 in a vertical alignment when distal end 29 of mounting bar 22 is raised or lowered, and guide pin 32, mounted in base part 18, performs the same function in relation to upright 26 when proximal end 33 of said mounting bar is raised or lowered.

Figure 2:
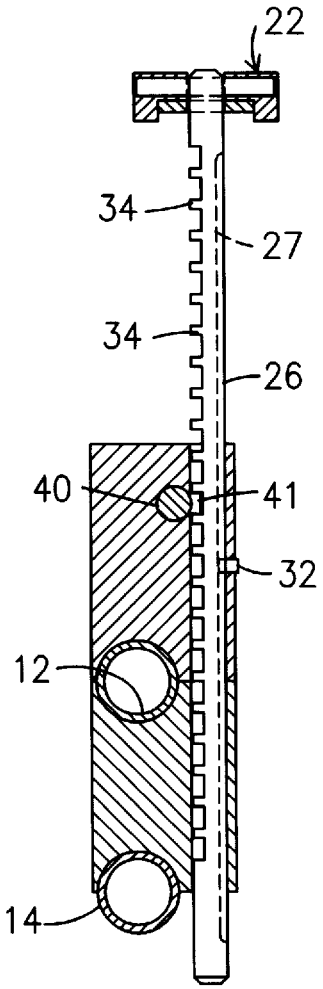
FIG. 2 is a sectional view taken along line 2—2 in FIG. 1.

As depicted in FIG. 2, a plurality of equidistantly spaced apart teeth, collectively denoted 34, are formed along the extent of upright 26. Upright 24 may share the same structure, but only one upright need be provided with said teeth. Thus, if upright 24 is untoothed, its position will remain fixed at all times. However, raising upright 26 will position the patient's elbow above the patient's wrist, and lowering upright 26 will have the opposite effect. Thus, it is not necessary to provide both uprights 24, 26 with teeth 34.

Figure 5:
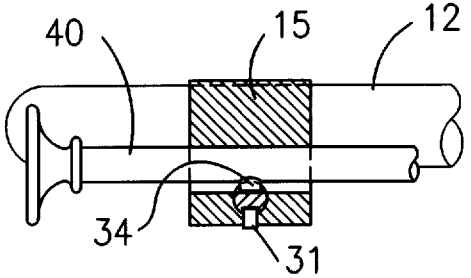
FIG. 5 is a partially sectional view taken along line 5—5 in FIG. 1.
Figure 6:
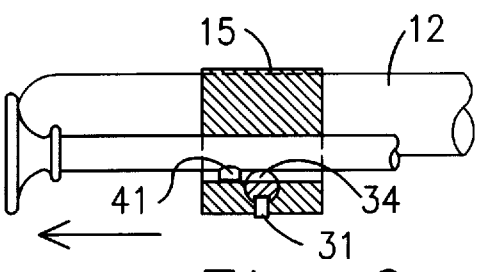
FIG. 6 is a view similar to FIG. 5, but with the handle depicted in said FIG. 5 displaced in the direction indicated by the directional arrow.

Teeth 34 and similar teeth formed in uprights 24 or 26 are engaged by distal and proximal stop members formed integral with locking rod 40 when said locking rod is in repose as depicted in FIG. 1. More particularly, said stop members project radially outwardly from locking rod 40. Although not illustrated in FIG. 1 to simplify the drawing, said stop members project out from the plane of the paper in normal relation thereto to occupy a space between contiguous teeth 34 when the locking rod is in repose, thereby preventing upward or downward movement of uprights 24 and 26 if both of said uprights are toothed. In the sectional view of FIG. 5, a tooth 34 obscures the distal stop member; however, said distal stop member is visible in FIG. 6, as at 41, because locking rod 40 is displaced from its position of repose in said Fig. When said stop members are misaligned with teeth 34, the uprights may be repositioned independently of each other to raise or lower mounting rod 22 and to adjust the angular inclination of said mounting rod. Note that the range of motion available for vertical displacement is substantially greater than the three or four inches provided by the constructions known heretofore, and that such range is a function of the novel design. Note further that the close spacing of the teeth increases the number of angular inclinations that may be achieved.

Locking rod 40 is maintained in its position of repose by a bias member 42, preferably in the form of a coil spring, that bears against flange 44 that is secured to the proximal end of said locking rod as depicted. To misalign the stop members and said teeth 34, i.e., to displace locking rod 40 to a position of nonrepose, handle 46 at the distal end of locking rod 40 is pulled in the direction indicated in FIG. 7 by single-headed directional arrows; such motion compresses bias means 42 as depicted in said FIG. 7. The respective positions of uprights 24, 26 is adjustable only when the bias member is compressed; releasing handle 46 returns the locking bar to its FIG. 1 position of repose so that uprights 24, 26 and hence mounting bar 22 are locked into position.

A cover may be employed to hide from view locking bar 40, spring 42, washer 44, base members 16, 18, and frame members 12, 14.

Mounting bar 22 provides a support surface upon which may be mounted any number of devices having therapeutic qualities. The devices may be securely mounted thereto and removed in the absence of tools. In a preferred embodiment, an arm rest member is detachably mounted to said mounting bar and various therapeutic devices are independently detachably mounted to the mounting bar adjacent the end of the mounting bar so that a single arm rest may be used in conjunction with a variety of therapeutic devices.

Figure 3:
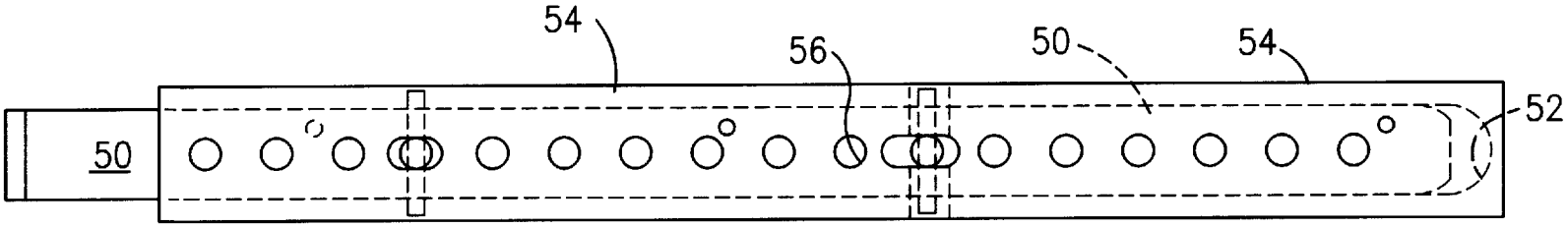
FIG. 3 is a top plan view of the mounting bar.
Figure 4:
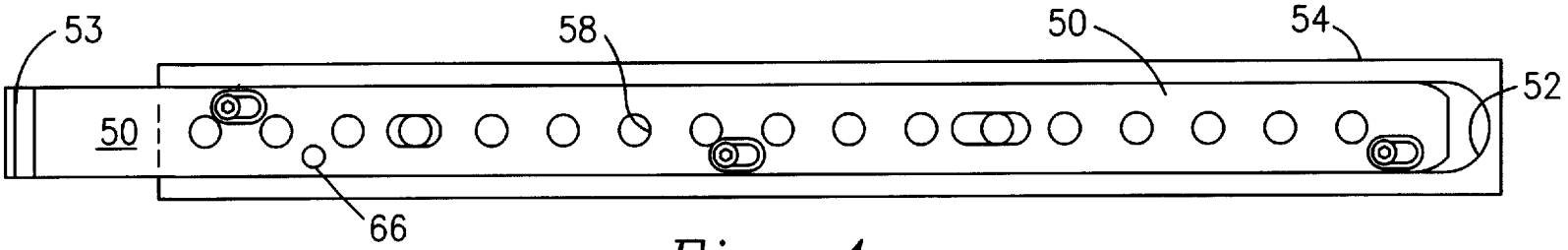
FIG. 4 is a bottom plan view of said mounting bar.
Figure 10:
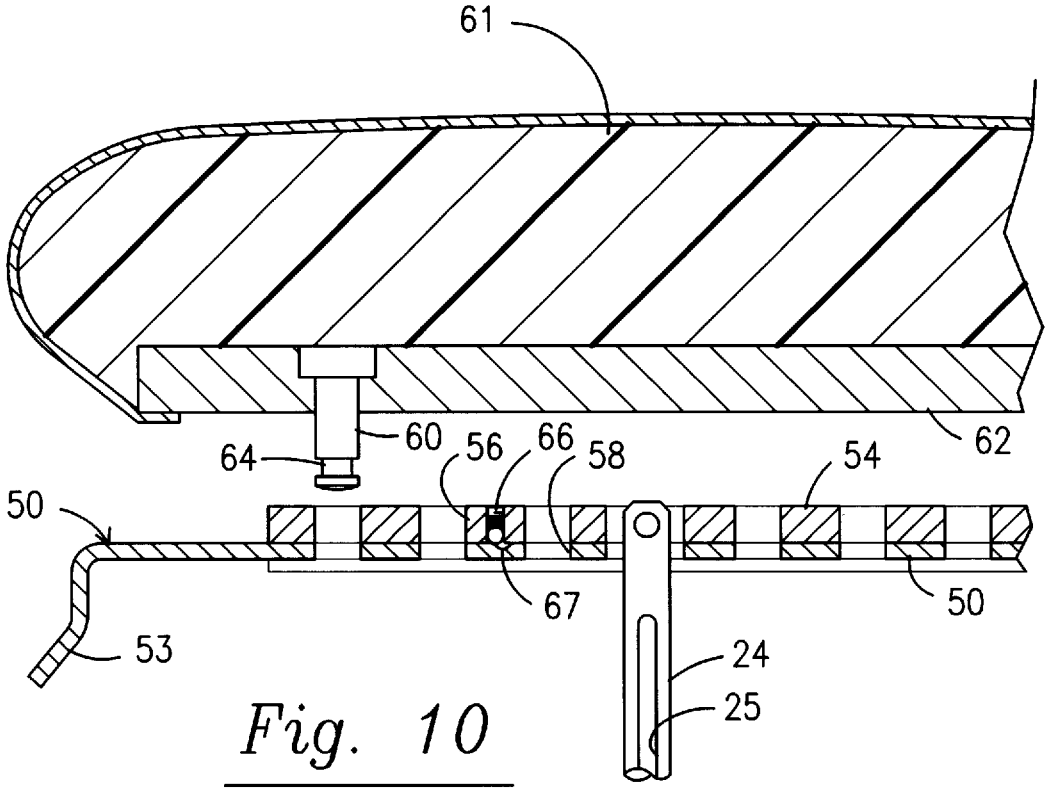
FIG. 10 is a partially sectional, side elevational view depicting the novel means for detachably securing an arm rest to the novel mounting bar.

As perhaps best understood in connection with FIGS. 3 and 4, mounting bar 22 has two primary parts. Elongate locking plate 50 is slideably mounted in an elongate groove 52 formed in elongate tray 54. A plurality of longitudinally and equidistantly spaced apart apertures 56, 58 are formed in plate 50 and tray 54, respectively. When said apertures are in alignment with one another, as depicted in FIG. 10, they cooperatively receive a mounting post 60 that depends from an attachment base 62. When misaligned, as depicted in FIG. 11, tray 54 engages an annular slot 64 formed in said post 60, thereby locking attachment base 62 into position and preventing its removal.

Figure 11:
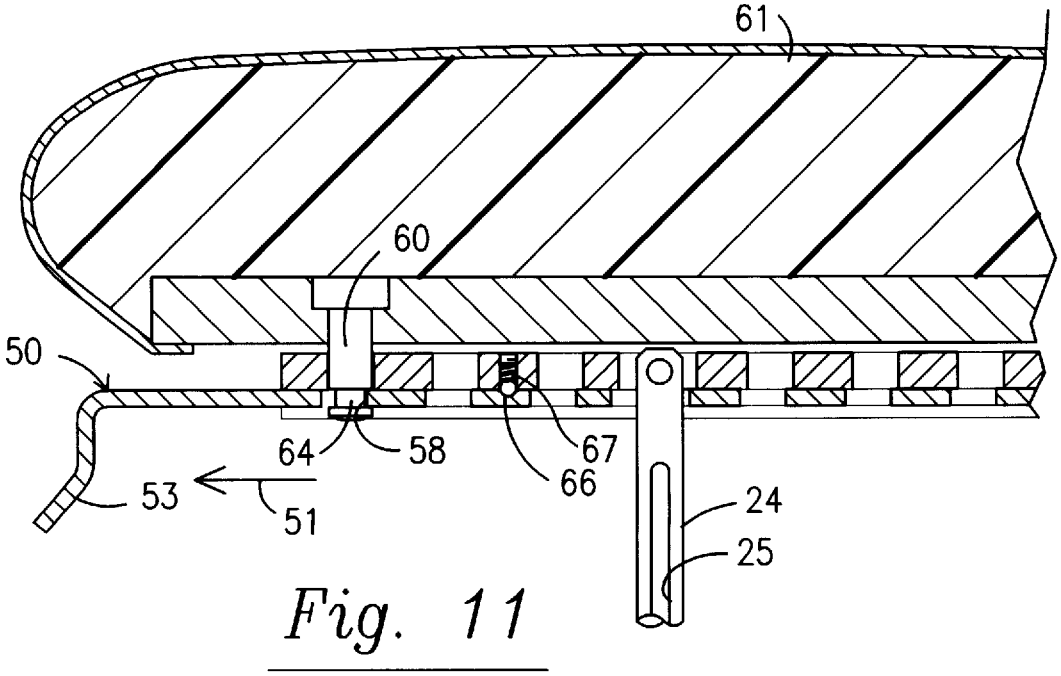
FIG. 11 is a view similar to FIG. 10, but showing the arm rest of FIG. 10 in its secured relation to said mounting bar.

The apertures 58 formed in plate 50 are aligned or misaligned with apertures 56 formed in tray 54 by sliding motion of plate 50 with respect to said tray 54; specifically, as indicated in FIG. 11, displacement of plate 50 in the direction indicated by directional arrow 51 misaligns said apertures; displacement in an opposite direction re-aligns the apertures and unlocks attachment base 62.

A spring-loaded ball bearing 66 (see FIGS. 4, 10, and 11) is misaligned with a recess 67 formed in plate 50 when apertures 56 and 58 are in alignment with one another, as depicted in FIG. 10, but is driven into said recess by spring 69 when said apertures are misaligned as depicted in FIG. 11. This prevents inadvertent unlocking of the mechanism. A suitable spring-loaded device is sold by Vlier (trademark) and is called a "stubby plunger."

The distal end of plate 50 is bent as indicated to provide a handle means 53 that facilitates sliding plate 50 with respect to tray 54; such sliding requires retraction of pin 66 from recess 67 as aforesaid.

Figure 17:
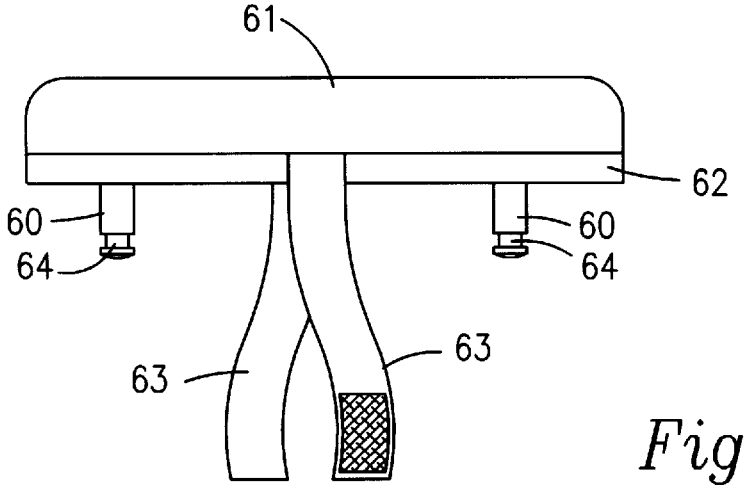
FIG. 17 is a side elevational view of an arm rest having flexible fastening means for holding a patient's arm thereatop.

A cushioned arm rest 61 is secured by suitable means to attachment plate 62 as depicted in FIGS. 10 and 11. Elongate flexible straps, collectively denoted 63 in FIG. 17, may be provided with complementary Velcro (trademark) fastening means to facilitate holding the patient's forearm atop said cushioned arm rest 61.

Figure 8:
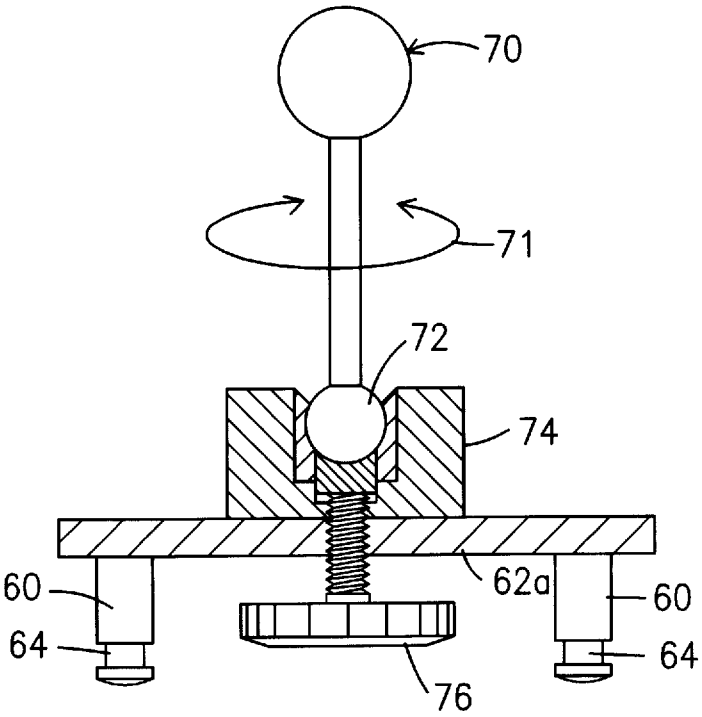
FIG. 8 is a partially sectional side elevational view of one of the novel therapeutic devices that may be detachably secured to the novel mounting bar.

A joystick 70 which may be swiveled in the well-known way, as indicated by double-headed directional arrow 71 in FIG. 8, provides therapeutic exercise for those patients capable of grasping it. The joystick includes a ball 72 mounted in socket 74; said socket 74 is detachably secured to attachment plate 62*a* (formed independently of attachment plate 62) by a screw 76 having a large, manually-engageable head to facilitate its turning. The external threads of the screw can engage any number of internally threaded devices, not just socket 74.

Figure 9:
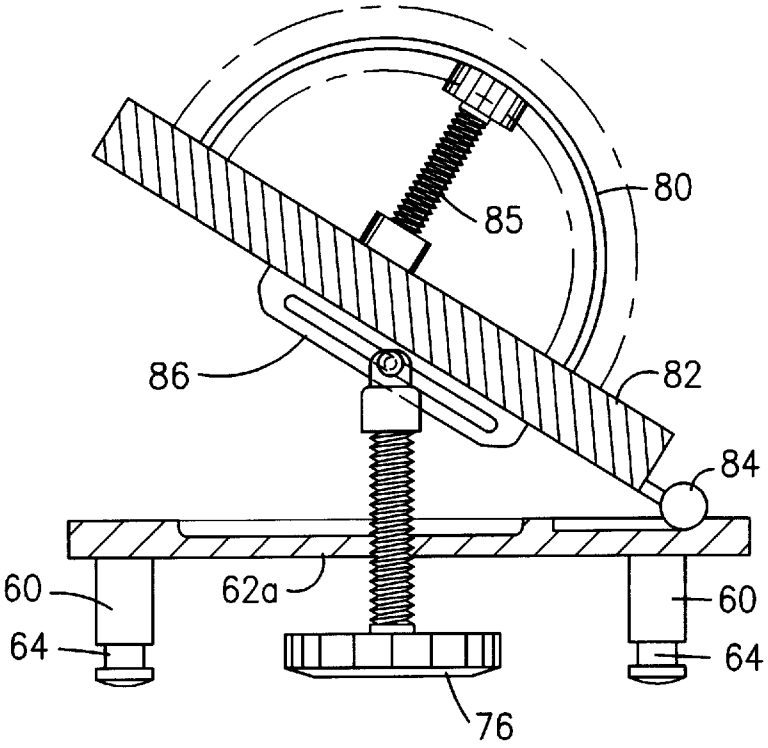
FIG. 9 is a partially sectional side elevational view of another novel therapeutic device that may be detachably secured to the novel mounting bar.

FIG. 9 depicts one of the multitude of other therapeutic devices that may be screwthreadedly attached to independently formed attachment plate 62*a*. This device includes a hemispherical member 80 that is detachably secured to a platform 82 by a screw 85. Accordingly, hemispherical devices of differing sizes may be attached to said platform 82 instead of the device depicted. Thus, a smaller hemispherical device would be attached for a person with small hands, for example. Nor is the invention limited to hemispherical devices, because devices of nonhemispherical shape may just as easily be secured to platform 82 by screw 85.

Platform 82 is pivotally attached to independently formed attachment plate 62*a* by a suitable hinge means 84 so that said platform may be adjusted to an angle determined by a therapist. The angle is adjusted by rotating screw 76; the free end of said screw engages a slotted member 86 secured to the underside of platform 82 as depicted. When a patient first begins therapy, it may be necessary to retract screw 76 to its fullest extent, to position platform 82 into coplanar relationship with attachment plate 62*a*. It may even be necessary to replace hemispherical member 80 with a device that is flat or only slightly convex. A first step in restoring the patient's hand might be replacing a flat member 80 with a slightly convex member 80, and progressively increasing the convexity until a hemispherical shape such as the depicted shape is attained. Such gradual treatment increases the arch of the patient's hand. Simultaneously, the angle between platform 82 and attachment plate 62*a* may be gradually increased to increase the flexibility of the patient's wrist. Thus, both the size and shape of member 80 are easily adjustable as is its angle of orientation. This provides the therapist with tools heretofore unavailable.

Figure 9A:
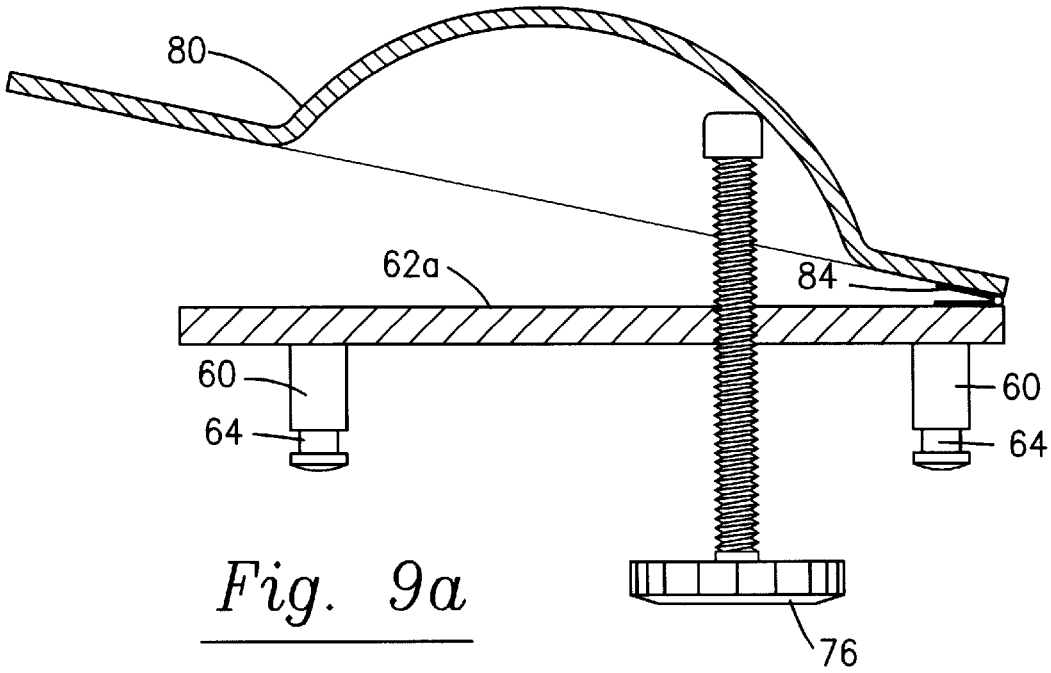
FIG. 9*a* is a partially sectional side elevational view of an alternative structure for the embodiment of FIG. 9.
Figure 9B:
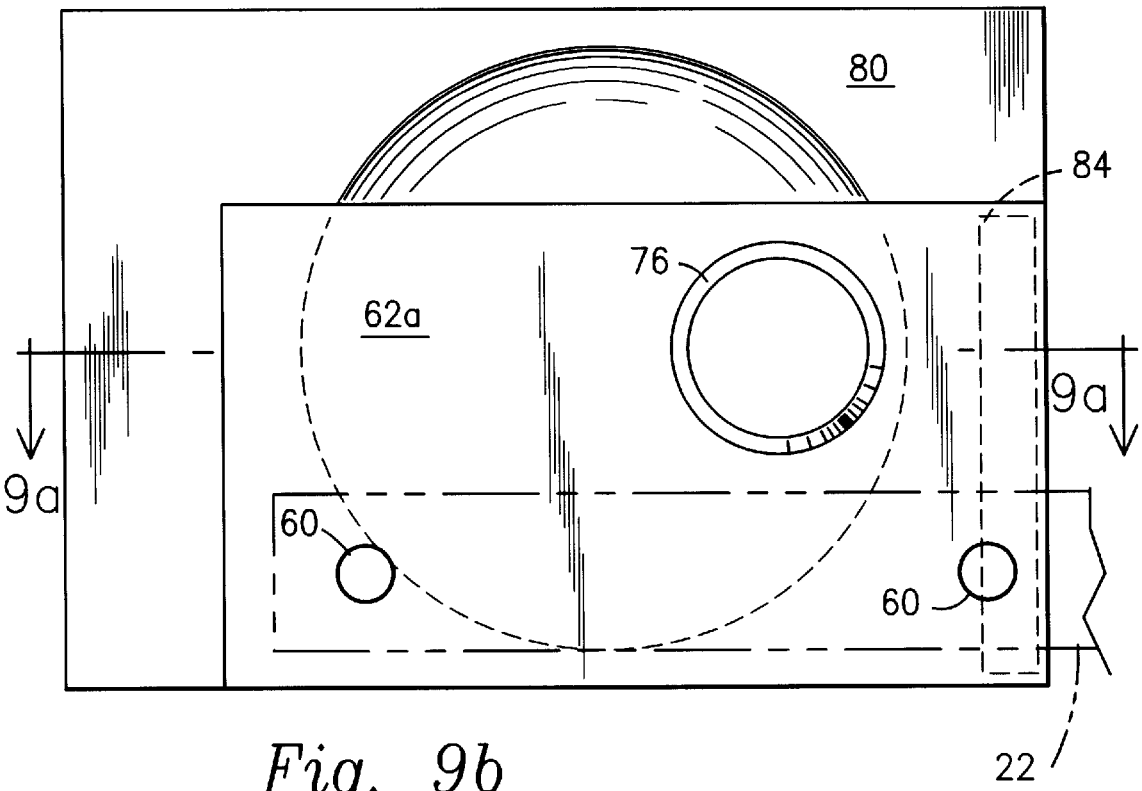
FIG. 9*b* is a top plan view of the embodiment of FIG. 9*a*.

FIGS. 9*a* and 9*b* depict a simplified version of the therapeutic device of FIG. 9. Hemispherical member 80 and platform 82 are merged into one piece, created by vacuum forming or similar technique.

Figure 12:
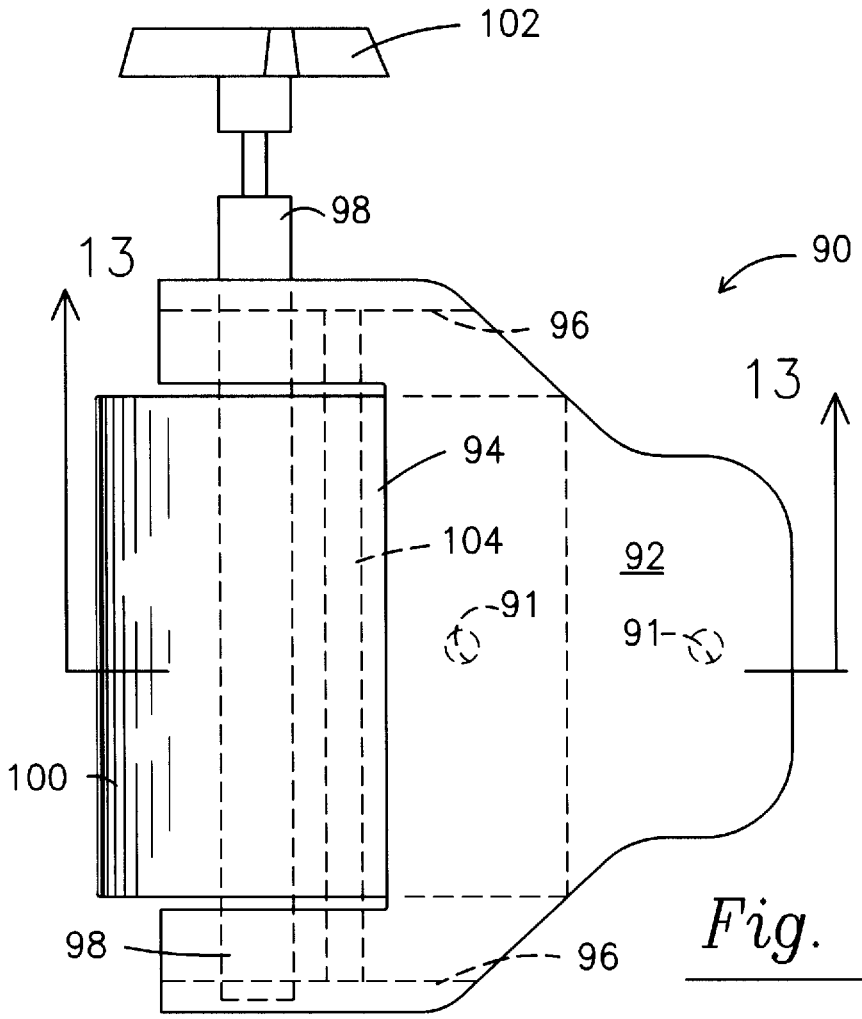
FIG. 12 is a top plan view of another therapeutic device that is detachably secureable to the novel mounting bar.
Figure 13:
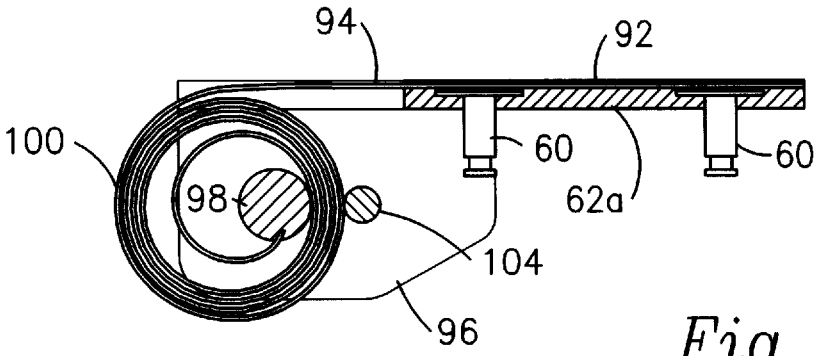
FIG. 13 is a sectional view taken along line 13—13 in FIG. 12.
Figure 14:
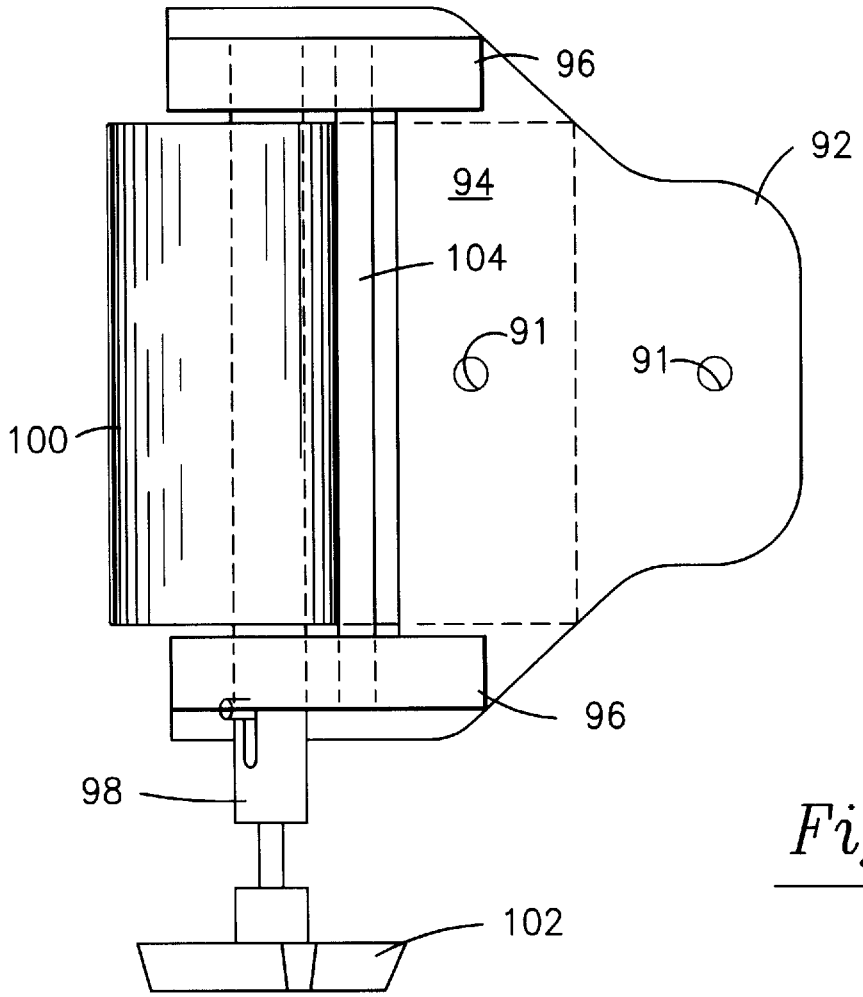
FIG. 14 is a bottom plan view of the device depicted in FIG. 12.

Another device that is releasably attachable to attachment plate 62*a* is depicted in detail in FIGS. 12–14, and is denoted 90 as a whole. However, it should be understood that device 90, again, is but one of an unlimited number of therapeutic devices that could be attached to attachment plate 62 or to independently formed attachment plate 62*a*.

Device 90 includes a flat mounting plate 92 having apertures 91, 91 formed therein as indicated in FIG. 12; said apertures receive mounting posts 60 as indicated in FIG. 13. A flat base 94, formed integrally with mounting plate 92, extends in a distal direction relative to mounting plate 92, in coplanar relationship therewith, and a pair of transversely spaced apart sidewalls 96, 96 depend therefrom. Sidewalls 96, 96 are respectively apertured to receive opposite ends of an axle 98 to which is attached a first end of a coil 100 of a flexible sheet of material such as a suitable heavy gauge plastic. Axle 98 is rotated about its axis of rotation by manipulating handle 102 (FIG. 12); rotation in a first direction increases the diameter of coil 100 and rotation in a second direction decreases said diameter. Secondary axle 104 cooperates with primary axle 98 to constrain a section of the coil so that rotation of said handle 102 is positively translated into an increase or decrease in the diameter of the coil. Coil 100 may be tightly wound, i.e., in its smallest diameter, at the beginning of a treatment program. Its diameter is progressively increased as the patient progresses.

FIG. 14 provides a bottom plan view of the same parts depicted in FIG. 12.

Note that it is a simple matter to mount the parts depicted in FIGS. 12–14 in a pivotal manner like the device depicted in FIG. 9.

Figure 15:
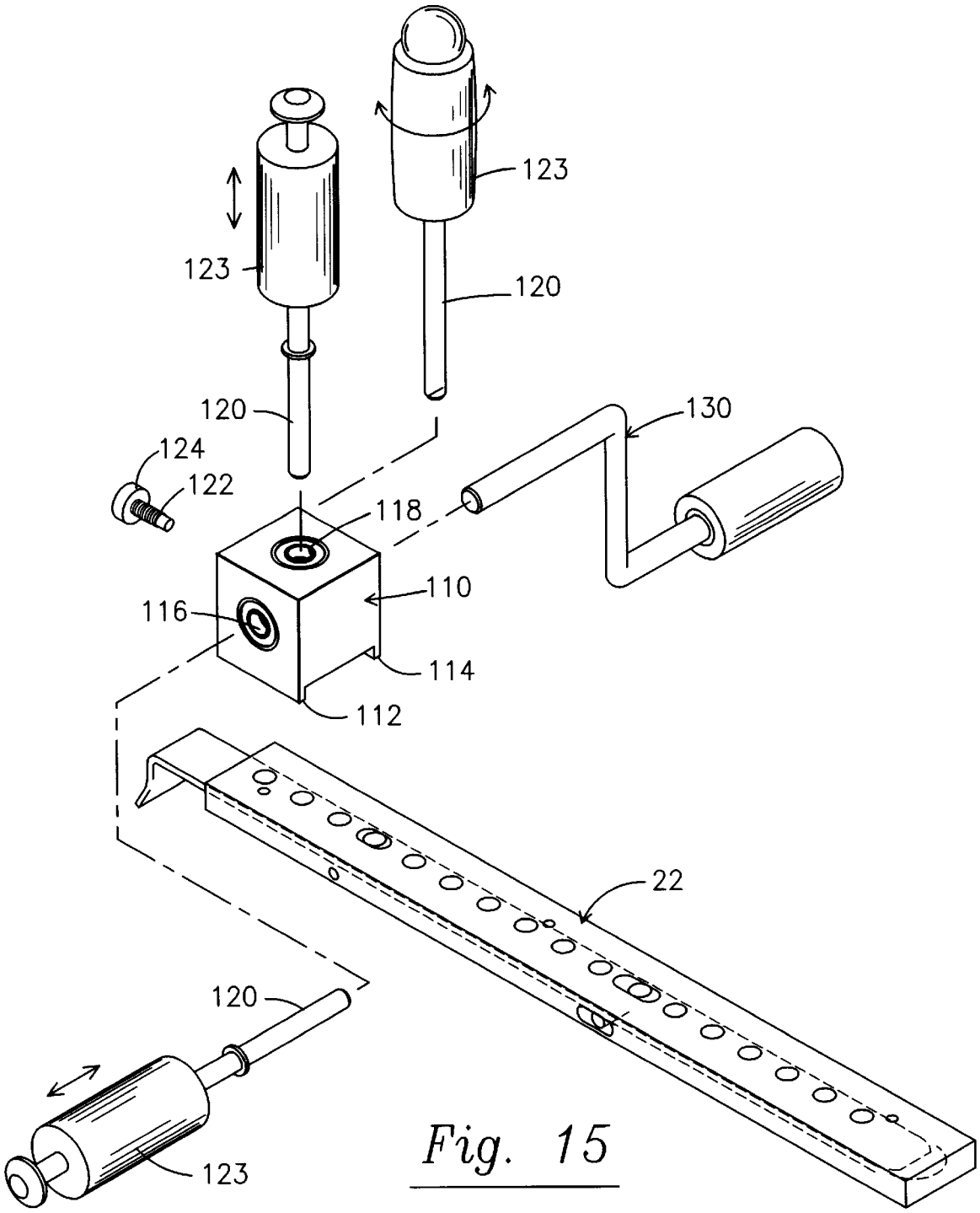
FIG. 15 is an exploded perspective view of a versatile, cube-shaped therapeutic device that may be detachably secured to the novel mounting bar.
Figure 16:
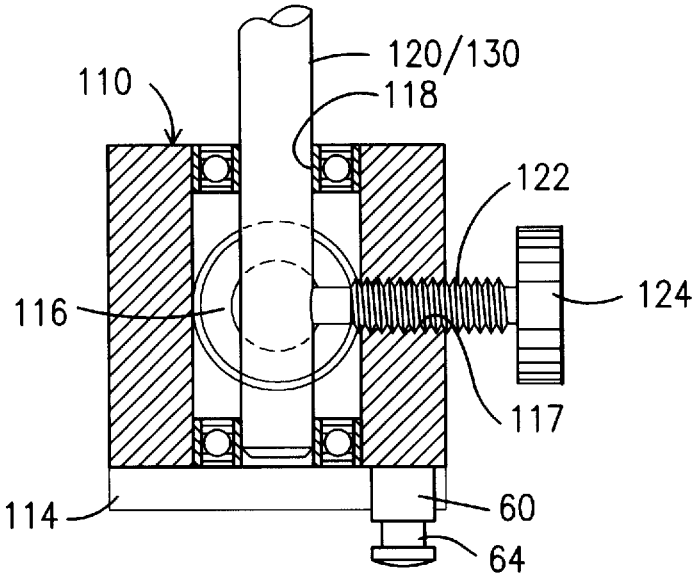
FIG. 16 is a sectional view of the versatile cube-shaped therapeutic device.

FIGS. 15 and 16 depict another novel element, to be known commercially as the Theracube (trademark). Element 110 is in the form of a cube with depending longitudinally extending skirts 112, 114 that serve to position it on mounting bar 22, preventing transverse displacement with respect thereto. A transversely extending throughbore 116 is formed in element 110, as is a vertically extending throughbore 118 which intersects said bore 116. A longitudinally extending bore 117 (FIG. 16) that intersects both throughbores is formed in element 110 as well, said bore having a substantially smaller diameter than said throughbores and said bore not extending through said element 110.

A rigid rod 120 is selectively positionable in either throughbore 116 or 118 and is slideably therewithin. A set screw 122 having knurled knob 124 facilitates locking said rod 120 into any preselected position of functionable adjustment within either throughbore 116 or 118. When set screw 122 is tightly secured to rod 120, said rod 120 cannot be moved. However, when said set screw is slightly loosened, a patient may rotate said rod or may axially displace it. Rod 120 may be covered by any suitable handle means 123. Moreover, a crank member such as crank 130 may be attached thereto so that a patient can rotate said rod by operating the crank in the well-known way. A cranking motion involves the patient's entire arm and thus provides substantial therapeutic benefits. A therapist can gradually tighten the set screw as the patient's strength increases so that rotating, cranking, or axially displacing the rod becomes increasingly more difficult as time passes.

Figure 18:
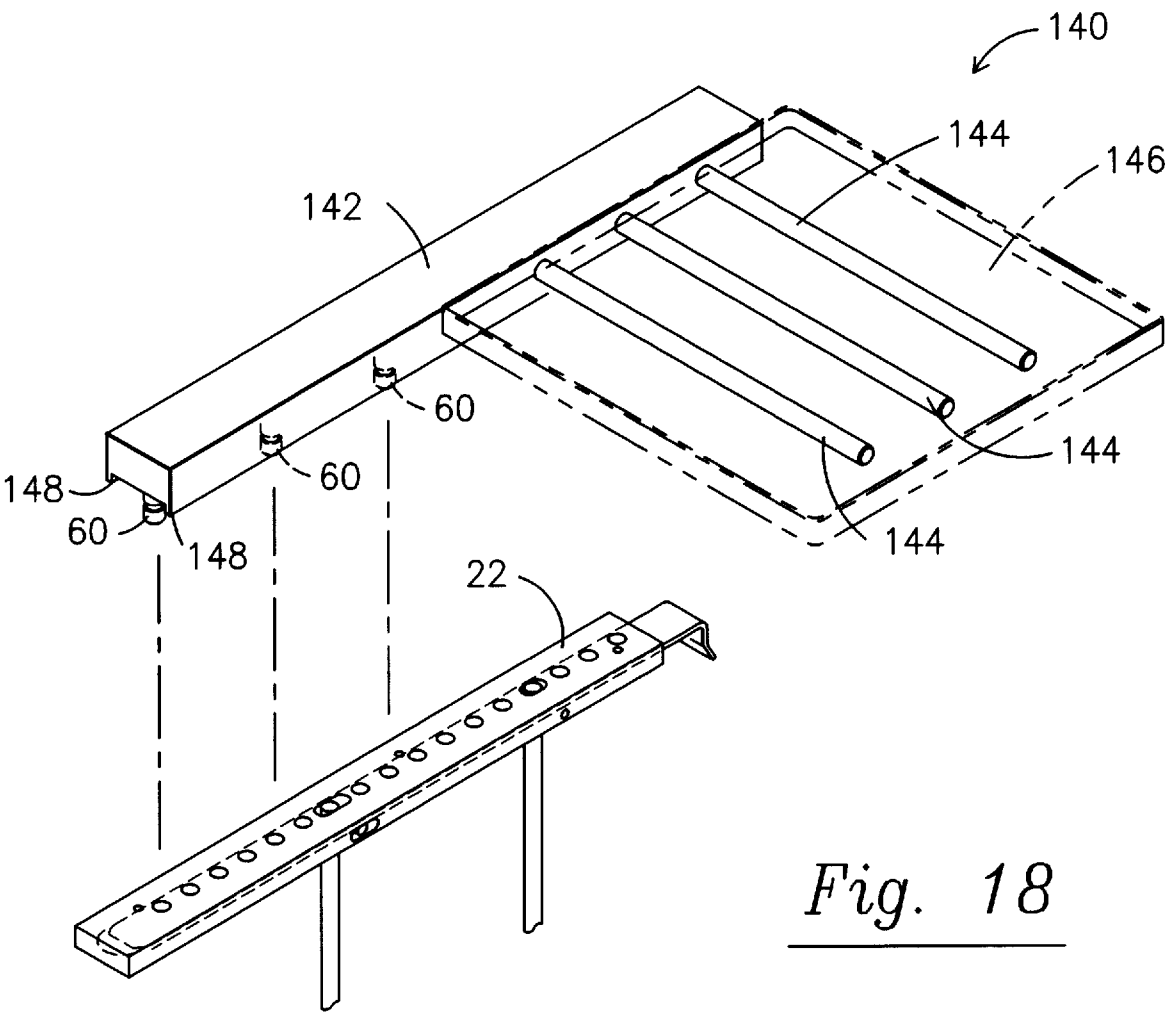
FIG. 18 is a perspective view of a lap tray that is detachably secureable to the novel mounting bar.
Figure 19:
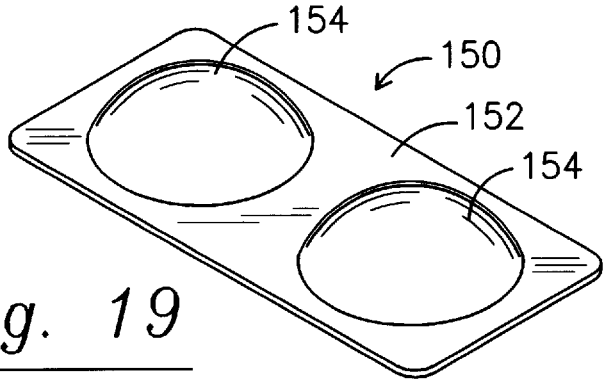
FIG. 19 is a perspective view of a device having utility in the treatment of hand conditions.

FIG. 18 depicts a lap tray 140 that is detachably connectable to mounting bar 22. It includes aluminum arm 142 having transverse steel rods 144 secured thereto; said rods support and are covered by a suitable plastic 146 that forms the tray surface. Depending skirts 148 serve to align arm 142 with mounting bar 22.

Figure 20:
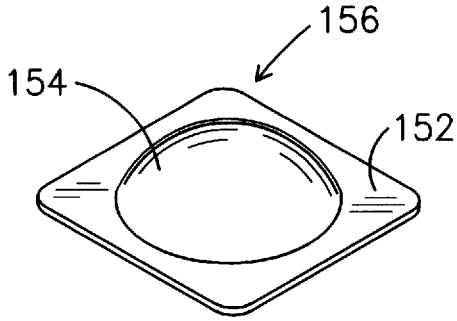
FIG. 20 is a perspective view of a device that is essentially half of the FIG. 19 device.
Figure 21:
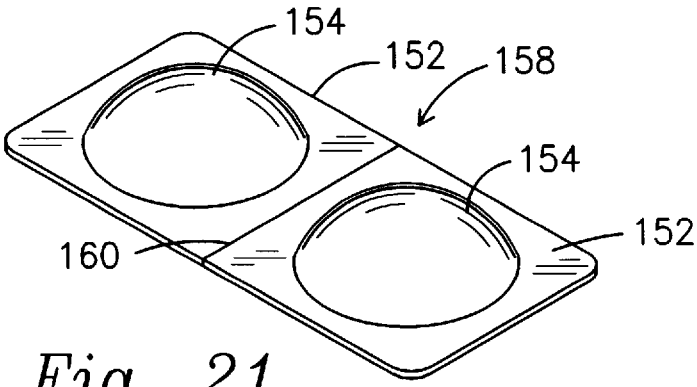
FIG. 21 is a perspective view of a hinged version of the FIG. 19 device.
Figure 22:
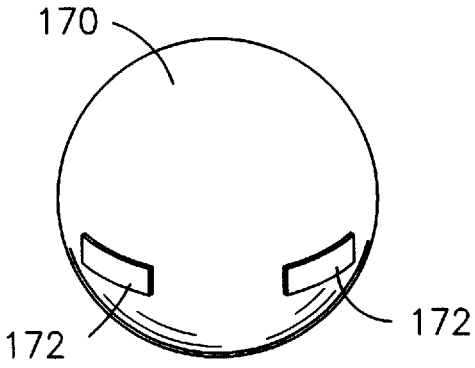
FIG. 22 is a perspective view of a ball having hook and loop fastening means secured to its surface at preselected locations.
Figure 23:
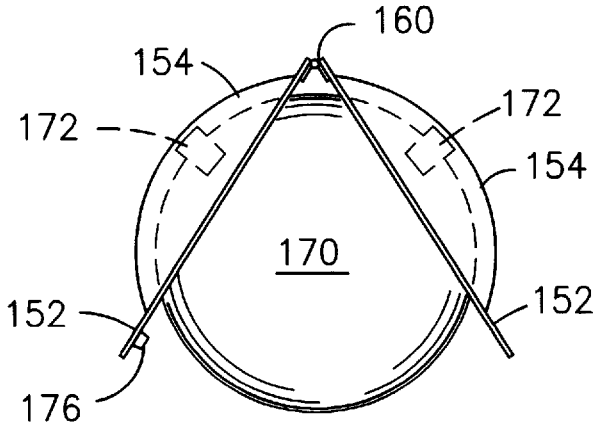
FIG. 23 is an elevational view of the ball of FIG. 22 when captured between the hinged parts of the FIG. 21 device.
Figure 24:
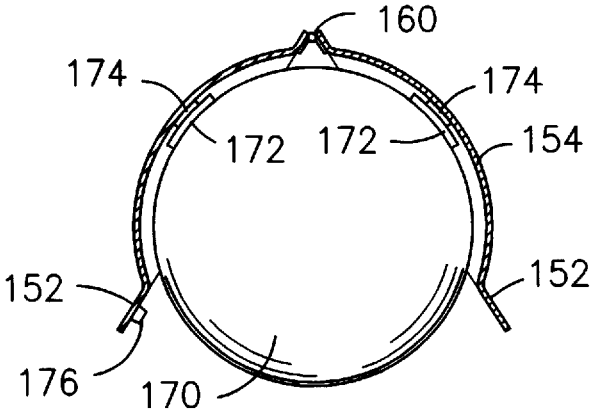
FIG. 24 is a sectional view of the FIG. 23 assembly, depicting mating hook and loop fastening means secured to an inner surface of the FIG. 21 device.

The devices depicted in FIGS. 19–24 may but need not be attached to novel mounting bar 22. Device 150, depicted in FIG. 19, includes a rigid flat plate 152 having a pair of rigid hemispherical domes 154 formed therein. The hands of a patient are placed into overlying relation to said domes 154 for thereapeutic purposes. (Device 150 is placed flat on a table top, domes up, as depicted, for use). Device 156, depicted in FIG. 20, is essentially the same device but it include only one dome 154. Device 158 of FIG. 21 adds a hinge means 160 to enable folding of the first and second parts 152, 152 of the device in the manner depicted in FIGS. 23 and 24 to capture an air-filled ball 170 (FIG. 22) having hook and loop fastening means 172, 172, secured thereto at preselected locations as depicted. The patient may squeeze the device when in its FIGS. 23 and 24 position; the resiliency of ball 170, coupled with the shape of domes 154, provides therapeutic benefits. Hook and loop fastening means 174, 174 secured to an inner surface of domes 154, 154, releasably engage mating strips 172, 172 in the well-known way when ball 170 is captured between the hinged first and second parts of device 158. Block member 176, secured to an inner surface of one of the flat plates 152, maintains flat plates 152, 152 in parallel alignment with one another when ball 170 is not captured therebetween. The patient also receives therapeutic benefits when said ball is not used and said parts 152, 152 are disposed in parallel relation to one another; device 158 is held between the hands in it fully folded position, i.e., with its first and second parts 152, 152 in parallel alignment with one another, with each hand resting on a dome 154, when so used.

The novel device thus has unlimited attachment means that aid the therapist in treating those with upper extremity disorders. All of the attachment means are quickly and easily attachable without tools to mounting bar 22, and the vertical and angular orientation of said attachment plate is quickly and easily adjustable in the absence of tools. Since all attachments and detachments are accomplished without tools, and since the therapeutic position of all of the attachments may also be quickly and easily changed without tools, the therapist may offer a wide range of treatments and those treatments are easily made progressively more challenging to the patient as therapy continues.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A therapeutic system for treating patient upper extremity disorders, comprising:

a pair of upstanding base members configured for adjustable attachment to a support member in a spaced apart relationship to one another;

an elongate mounting bar having a distal end and a proximal end;

said mounting bar further including attachment means for detachably securing preselected therapeutic devices that are manipulable by a patient;

a pair of independently mounted uprights disposed in interconnecting relation between said mounting bar and said pair of upstanding base members;

said uprights being independently slideably mounted relative to said upstanding base members and said mounting bar being slideably attached to said uprights so that said mounting bar is positionable in a plurality of functional positions of height and angular adjustment relative to said upstanding base members;

locking means for independently locking said uprights in a preselected position of adjustment;

the locking means further including a locking bar that is slideably mounted relative to said upstanding base members, said locking bar having a position of repose where said uprights are independently locked into a preselected position of adjustment and said locking bar having a nonrepose position that is slideably displaced from said position of repose, said uprights being independently movable when said locking bar is in said nonrepose position; and the locking means further including a plurality of equidistantly spaced apart teeth formed along an extent of each of said uprights, said locking bar engaging said teeth when in its position of repose and said locking bar not engaging said teeth when in its position of nonrepose.

2. The therapeutic system of claim 1, wherein said locking means further includes a pair of integrally formed stop members formed in said locking bar, said stop members being spaced apart from one another a distance equal to said spaced apart relationship between said upstanding base members, said stop members projecting radially outwardly from said locking bar and being positioned between contiguous teeth formed in said uprights when said locking bar is in a position of repose, thereby blocking sliding movement of said uprights relative to said base members, and said stop members being spaced apart from said teeth members to permit sliding movement of said uprights relative to said upstanding base members when said locking bar is in position of nonrepose.

3. The therapeutic system of claim 2, wherein said uprights and upstanding base members further include an elongate slot formed in each of said uprights and a guide pin mounted in each of said upstanding base members, each of said guide pins slideably engaging an associated slot.

4. A therapeutic system for treating patient upper extremity disorders, comprising:

a pair of upstanding base members configured for adjustable attachment to a support member in a spaced apart relationship to one another;

an elongate mounting bar having a distal end and a proximal end;

said mounting bar further including attachment means for detachably securing preselected therapeutic devices that are manipulable by a patient;

a pair of independently mounted uprights disposed in interconnecting relation between said mounting bar and said pair of upstanding base members;

said uprights being independently slideably mounted relative to said upstanding bar members and said mounting bar being slideably attached to said uprights so that said mounting bar is positionable in a plurality of functional positions of height and angular adjustment relative to said upstanding base members; and the mounting bar further including an elongate plate, an elongate groove formed in said elongate plate, an elongate tray slidedly received within said elongate groove, a plurality of apertures being formed in said elongate plate and tray in equidistantly spaced relation to one another along respective extends of said elongate plate and tray; said apertures being in aligned relationship with one another when said tray is in a first position relative to said plate and said apertures being in misaligned relationship with one another when said tray is in a second position relative to said plate.

5. The therapeutic system of claim 4, further comprising a handle means integrally formed at a distal end of said elongate plate to facilitate sliding movement of said tray with respect to said elongate plate.

6. The therapeutic system of claim 5, wherein said distal end of said elongate plate is bent to form said handle means.

7. The therapeutic system of claim 5, further comprising an attachment plate, said attachment plate being adapted for releasable engagement with said mounting bar, said attachment plate being disengaged from said mounting bar when said tray is in said first position relative to said plate, and said attachment plate being engaged with said mounting bar when said tray is in said second position relative to said plate.

8. The therapeutic system of claim 7, further comprising at least one mounting post disposed in depending relation from said attachment plate, said at least one mounting post having an annular groove formed therein and said annular groove being engaged by an aperture formed in said tray when said tray is in said second position relative to said plate, so that said at least one depending post and hence said attachment plate are secured to said mounting bar when said tray is in said second position.

9. The therapeutic system of claim 7, further comprising a cushioned arm rest attached to said attachment plate.

10. The therapeutic system of claim 7, further comprising a therapeutic device for providing therapeutic benefits to an individual's hand, said therapeutic device being detachably secured to a distal end of said attachment plate.

11. The therapeutic system of claim 10, wherein said therapeutic device is a joystick.

12. The therapeutic system of claim 10, wherein said therapeutic device is a convex member for supporting said individual's palm.

13. The therapeutic system of claim 10, wherein said therapeutic device is pivotally mounted to said attachment plate.

14. The therapeutic system of claim 10, wherein said therapeutic member includes a roll of flexible material coiled about an axle, said roll of flexible material increasing in diameter when said axle is rotated about its axis in a first direction and said roll decreasing in diameter when said axle is rotated in a second direction opposite to said first direction.

15. The therapeutic system of claim 5, further comprising a therapeutic device detachably secured to said mounting bar.

16. The therapeutic system of claim 15, wherein said therapeutic device is cube-shaped.

17. The therapeutic system of claim 16, wherein said cubed-shape therapeutic device is bored to slidingly receive a plurality of differing therapeutic devices that are emanipulable by a patient.

18. The therapeutic system of claim 17, wherein said cube-shaped therapeutic device further includes means for adjusting resistance to movement of said differing therapeutic devices that are manipulable by a patient.

19. The therapeutic system of claim 5, further comprising a lap tray detachably securable to said mounting bar.

* * * * *